US006536402B2

(12) United States Patent
Houchin et al.

(10) Patent No.: US 6,536,402 B2
(45) Date of Patent: Mar. 25, 2003

(54) PROGRAMMABLE TORQUE LIMIT

(75) Inventors: Thomas J. Houchin, Peoria, IL (US); Richard P. Laird, Lafayette, IN (US); Kevin A. Lantz, Peoria, IL (US); David E. Redfield, Marquette Heights, IL (US); Christopher J. Wichael, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/848,405

(22) Filed: May 4, 2001

(65) Prior Publication Data

US 2002/0162533 A1 Nov. 7, 2002

(51) Int. Cl.[7] ..... F02B 77/00; F02D 29/00

(52) U.S. Cl. ..... 123/198 D; 123/198 DB; 701/84; 701/104; 417/212

(58) Field of Search ..... 123/352, 435, 123/436, 472, 480, 689, 679, 481, 198 D, 198 DB; 701/104, 110, 84; 417/212

(56) References Cited

U.S. PATENT DOCUMENTS

| | | | | |
|---|---|---|---|---|
| 3,913,419 A | | 10/1975 | Sale et al. | |
| 4,601,270 A | | 7/1986 | Kimberley et al. | |
| 4,917,063 A | | 4/1990 | Hiraki | |
| 5,094,301 A | | 3/1992 | Wipperman et al. | |
| 5,435,192 A | | 7/1995 | Eagan et al. | |
| 5,508,923 A | | 4/1996 | Ibamoto et al. | |
| 5,512,031 A | | 4/1996 | Ziems et al. | |
| 5,543,695 A | | 8/1996 | Culp et al. | |
| 5,583,420 A | | 12/1996 | Rice et al. | |
| 5,647,317 A | | 7/1997 | Weisman, III et al. | |
| 5,689,159 A | | 11/1997 | Culp et al. | |
| 5,740,044 A | | 4/1998 | Ehrenhardt et al. | |
| 5,884,210 A | | 3/1999 | Rettig et al. | |
| 5,988,141 A | * | 11/1999 | Uchida | 123/436 |
| 6,006,724 A | * | 12/1999 | Takahashi et al. | 123/339.19 |
| 6,078,859 A | | 6/2000 | Jastrzebski et al. | |
| 6,092,504 A | | 7/2000 | Barnes et al. | |
| 6,141,618 A | * | 10/2000 | Yamashita et al. | 701/84 |
| 6,144,913 A | | 11/2000 | Braun et al. | |
| 6,165,102 A | | 12/2000 | Bellinger | |
| 6,183,210 B1 | * | 2/2001 | Nakamura | 417/222.1 |
| 6,298,824 B1 | * | 10/2001 | Suhre | 123/406.49 |

FOREIGN PATENT DOCUMENTS

| | | | | |
|---|---|---|---|---|
| JP | 141373 | * | 5/1999 | F02D/41/04 |

* cited by examiner

*Primary Examiner*—Henry C. Yuen
*Assistant Examiner*—Hai Huynh

(57) ABSTRACT

An engine control system, dredging system, and a method for controlling torque output of an engine. An engine control system controls torque output of an engine. At least one sensor is coupled with the engine. The sensor monitors and transmits operating data of the engine. An electronic device coupled to the sensor is operable to control the engine as a function of the transmitted operating data. The engine is controlled by the electronic device to operate substantially at a predetermined torque limit over a predetermined range of engine speeds, by determining and regulating an amount of fuel to the engine. Alternatively, the engine is controlled by the electronic device to operate substantially at, and between predetermined upper and lower torque limits over a predetermined range of engine speeds, by determining and regulating an amount of fuel to the engine.

12 Claims, 4 Drawing Sheets

PROGRAMMABLE TORQUE LIMIT

TECHNICAL FIELD

The present invention relates to an engine control system, a method for controlling an engine, and a dredging system using the engine control system, and in particular to a programmable engine control system, dredging system, and method in which engine torque can be controlled and monitored over a predetermined range of engine speeds.

BACKGROUND

Dredging is an activity performed in a river or canal etc., where a boat has an engine which drives a pump that, in effect, sucks material from the bottom of the river to increase the depth of the river. In a dredging operation, a pump, such as a centrifugal pump is used, in which an impeller within the pump casing expels by centrifugal action a mixture of solids, water, and gases. As a partial vacuum is created within the pump, atmospheric pressure on the outside water surface along with the weight of the water itself (hydrostatic pressure) both act to force water and suspended solids from the bottom of a river or channel through the suction pipe into the pump. In this type of dredging, the materials emerging from the pump are placed onto barges or through another pipe to the shore.

In operation, the engine of the boat is used to run the dredging machinery, as well as used for its normal function of driving the propeller of the boat. When a dredging operation begins, the engine is connected to a shaft driving the dredging pump, and to the propeller. The engine can also be connected to other devices, such as a generator, to provide power as needed to these devices, even if the power is needed simultaneously. If the engine is configured to drive multiple devices (e.g., the torque limit is set to enable the engine to drive multiple devices), if one of the devices cuts off (e.g., the propeller is stopped), all of the engine torque is provided to the remaining device, e.g., shaft of the dredge pump, and the shaft of the dredge pump is unable to withstand such torque and accordingly, shaft or pump damage results.

SUMMARY OF THE INVENTION

The present invention relates to an engine control system, a method for controlling an engine, and a dredging system using the engine control system, and in particular to a programmable engine control system, dredging system, and method in which engine torque can be controlled and monitored over a predetermined range of engine speeds.

An engine control system controls torque output of an engine. At least one sensor is coupled with the engine. The sensor monitors and transmits operating data of the engine. An electronic device coupled to the sensor is operable to control the engine as a function of the transmitted operating data.

The engine is controlled by the electronic device to operate substantially at a predetermined torque limit over a predetermined range of engine speeds, by determining and regulating an amount of fuel to the engine. Alternatively, the engine is controlled by the electronic device to operate substantially at, and between predetermined upper and lower torque limits over a predetermined range of engine speeds, by determining and regulating an amount of fuel to the engine.

BRIEF DESCRIPTION OF THE DRAWINGS

The features and advantages of this invention, and the manner of attaining them, will become more apparent and the invention will be better understood by reference to the following description of the present invention taken in conjunction with the accompanying drawings, wherein.

DETAILED DESCRIPTION

Figure 1:
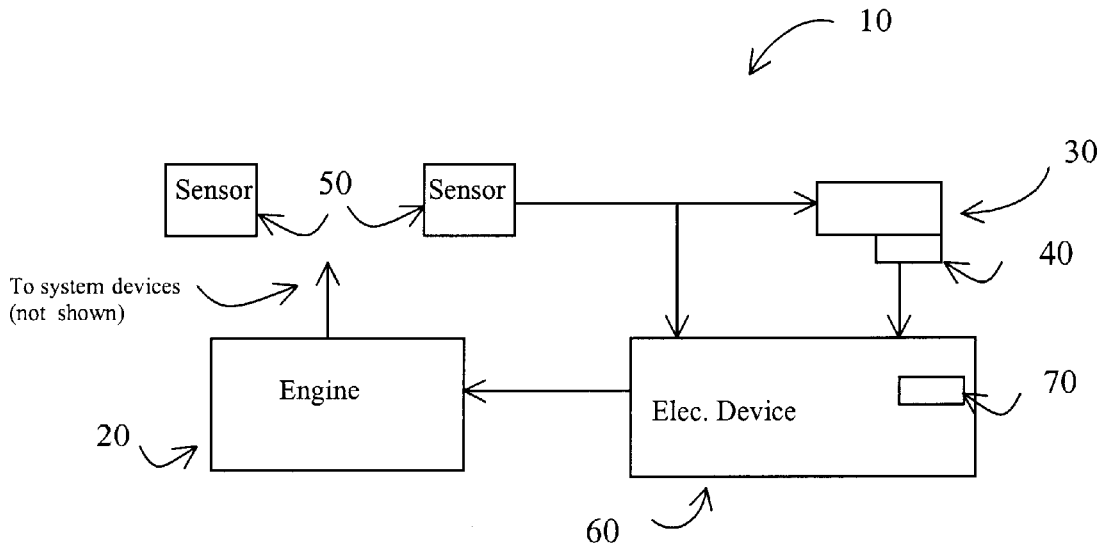
FIG. 1 illustrates an engine control system for controlling torque output of an engine according to a first embodiment of the present invention.

While the invention described herein is susceptible to various modifications and alternative forms, specific embodiments thereof have been shown solely by way of example in the drawings and are herein described in detail. It should be understood, however, that there is no intent to limit the invention to the particular form disclosed, but on the contrary, the intention is to cover all modifications, equivalents, and alternatives falling within the spirit and scope of the invention as defined by the appended claims.

FIG. 1 displays an engine control system 10 for controlling torque output of an engine 20 according to a first embodiment of the present invention. An optional display 30 shows engine operating data, such as engine speed, as well as system operating data, such as torque limits of the engine, pump fluid flow, pressure of fluids in the system, fuel quantity, temperature of system components, etc. This engine and system operating data may be displayed to an operator, in for example, the pilothouse of a boat by ways known to those skilled in the art. In this example, the system envisioned consists of components such as the engine 20, a dredge pump, connecting shafts, boat propeller, boat electrical and hydraulic systems, etc., (not shown), which are used during dredging operations.

In this embodiment, an input device 40, such as a switch, is activated for setting a fixed torque limit of the engine. In other embodiments the input device may be some type of sensor that transmits an activation signal indicative of a predetermined condition being detected. This would in effect, automatically activate the torque limiting. Other embodiments may not use any input or activation device, thus keeping the torque limiting function constantly active. During system operation, e.g., during dredging, sensors 50 attached to the aforementioned system components monitor and collect the engine operating data, as well as the system operating data which may then be transmitted to the display 30 and to an electronic device 60, such as, for example, a programmable electronic controller. The electronic device 60 controls the engine to operate at the torque limit which was set using input device 40 over a predetermined range of engine speeds, by controlling and regulating the amount of fuel needed by the engine 20 in order to maintain the torque limit. The predetermined range of speeds typically depends on.engine design. For example, a CAT 3500B engine available through Caterpillar Inc. is capable of operating in a range of 0 to 2400 rpm. Accordingly, the present invention allows for torque to be controlled over multiple engine speeds, as opposed to fixed engine speeds. Also in this embodiment, the set torque may be stored in memory or storage device 70, which may be integrated with the electronic device 60, although it need not be.

Figure 2:
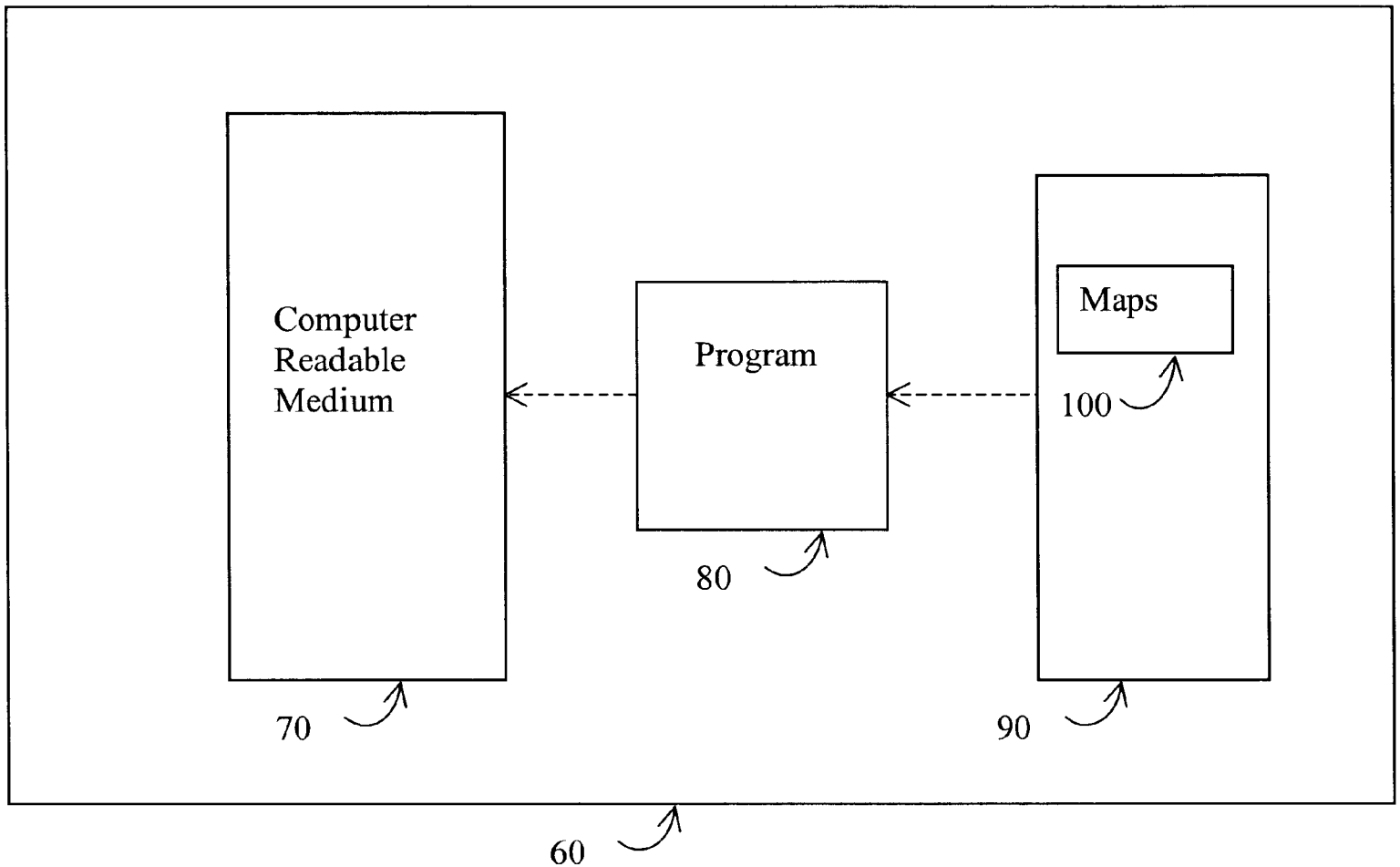
FIG. 2 illustrates an electronic device according to one embodiment of the present invention.

FIG. 2 illustrates an electronic device 60 according to one embodiment of the present invention. The electronic device 60 contains a computer readable medium 70, on which is stored a computer program 80. The computer program 80 stores instructions 90 which include maps 100 based on engine temperature. The maps 100 may include torque maps, torque limit maps, and timing maps, and may be used by the electronic device 60 to determine an amount of fuel needed by the engine 20 in order to maintain the torque limit. The instructions 90 and maps 100 can be developed based on engine empirical data, and programmed into a language understandable by the electronic device 60.

In one embodiment of the present invention, the maps 100 can be based on temperatures of the engine, such as low, medium, and high (e.g., cold, warm, hot) temperatures. As an example, maps based on 30 ° C., 60° C., and 90° C. SCAC temperature may be used. Multiple temperature maps may be used because when some large engines operate at a low engine temperature, for example, at a start-up condition, more fuel may be required to maintain a constant torque for the engine, than when the engine is operating at a high temperature. Including a plurality of maps at engine operating set points such as the temperatures described above enables the electronic device 60 to regulate fuel accordingly. Alternatively, only a single temperature map may be used, of course.

Further, the instructions 90 may also be capable of interpolating and extrapolating the maps 100 for engine temperatures falling between or outside of the maps 100 to determine a sufficient fuel quantity or fuel position, i.e., rack value at these temperatures. In addition, the instructions 90 may also include a feature wherein when a system sensor 50 indicates an out-of normal operating condition, e.g., if coolant temperature fails, a shaft or oil line breaks, or a pump malfunctions, etc., the electronic device 60 defaults to use the maps 100 based on a low temperature of the engine 20. As discussed above, using this lower temperature map would encourage more fuel to be provided to the engine, which is useful in helping maintain essential boat systems until the out-of normal operating condition can be examined.

Further, instructions 90 may also include a feature wherein when sensors 50 indicate that a predetermined engine or operating condition occurs, e.g., a pump is activated, control of engine torque is automatically initiated. Sensors 50 would, for example, measure current or voltage conditions of a system component, rotation of a shaft, etc., for sensing this predetermined condition. This later feature of the electronic device 60 may reduce the amount of operator time required to operate the system. In addition, the input device 40, as described above, may be eliminated from the engine control system 10.

Figure 3:
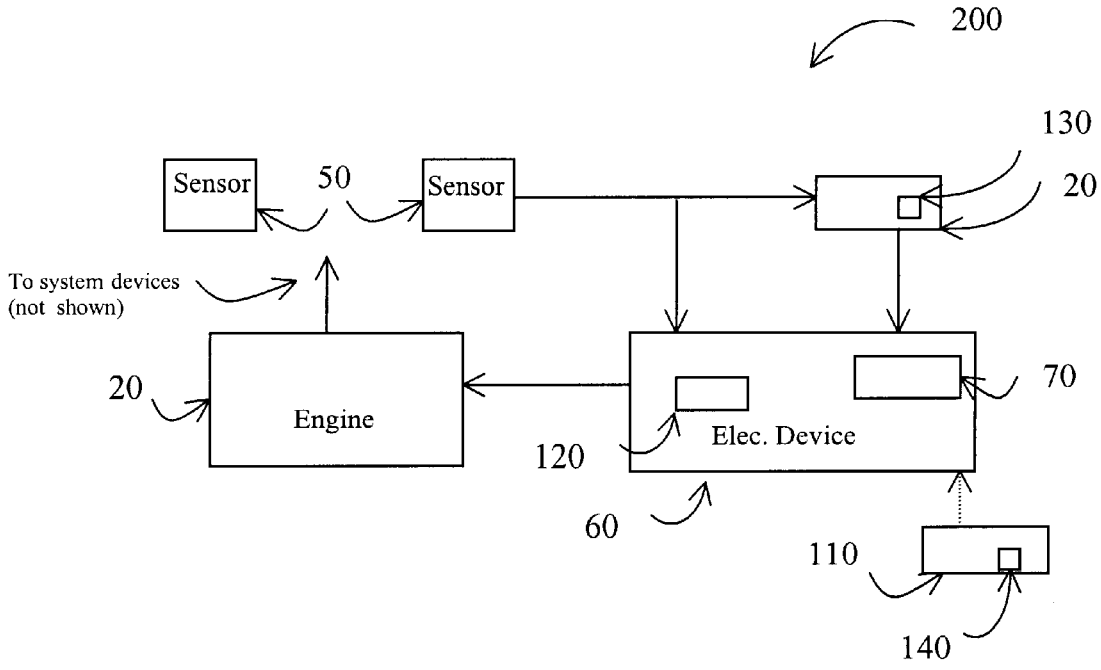
FIG. 3 illustrates an engine control system for controlling torque output of an engine according to a second embodiment of the present invention.

A second embodiment of an engine control system 200 of the present invention is shown in FIG. 3. Items shown in FIG. 3 that are essentially similar to those shown in FIG. 1, retain their same numerical identification. As shown in FIG. 3, the second embodiment of the present invention includes an input device 110 which may set upper and/or lower torque limits of the engine 20. The electronic device 60 controls the engine 20 to operate between the upper and lower torque limits using the transmitted system operating data. Either of the aforementioned embodiments may also include a feature whereby the highest torque limit that can be input typically cannot exceed maximum torque speed of the engine (typically at "peak torque speed"). Likewise, the input device 110 and instructions 90 of the electronic device 60 may be used to limit the lowest torque limit that an operator can input as a torque value. One of ordinary skill in the art will recognize that input device 110 can include among other things, a control at the pilothouse for setting the torque limits, an input device on the electronic device 60 itself for setting the torque limits, or a wireless transmitter which transmits the torque limits to the electronic device 60. The wireless solution may allow the pilot to control dredging operations from the deck of the boat, as well as the pilothouse.

In one embodiment of the present invention, the engine control system 10, 200 may also contain a recorder 120 that records the system operating data that can be used, for example, to review operator practices, streamline troubleshooting, and speed up service. In addition, other embodiments may include a warning device 130 that warns the operator of any non-standard operating condition, and an operator override switch 140 that overrides the electronic device 60. The operator override switch 140 shown in this embodiment may be integrated into the input device 110, although it need not be.

Figure 4:
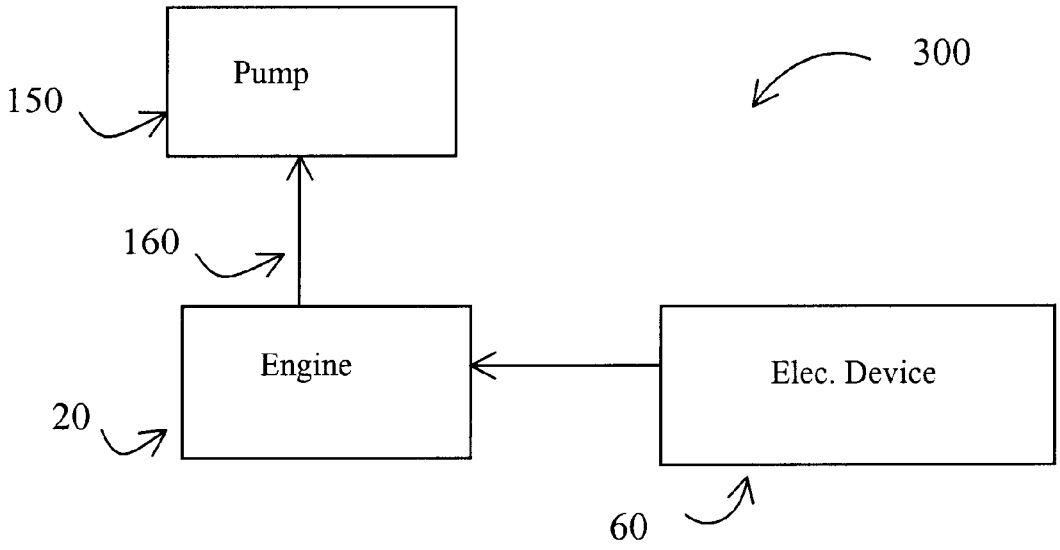
FIG. 4 illustrates a dredging system according to an embodiment of the present invention

A dredging system 300 according to one embodiment of the present invention is shown in FIG. 4. Here again, items shown in FIG. 4 that are essentially similar to those shown in FIG. 1, retain their same numerical identification. In the dredging system 300, the engine 20 supplies power to the dredging system 300 and to a pump 150. The pump 150 may be driven by shaft 160 connected to the engine 20. The pump 150 displaces material, such as, for example, sediment from the bottom of a river. During a dredging operation, an electronic device 60, such as, for example, the one discussed above controls the engine 20 at a torque limit over a predetermined range of engine speeds, by determining and regulating an amount of fuel to the engine. In this embodiment, when the pump 150 is activated, the electronic device 60 may derate the engine 20. Of course, upper and lower torque limits may also be set and controlled by the electronic device 60.

Figure 5:
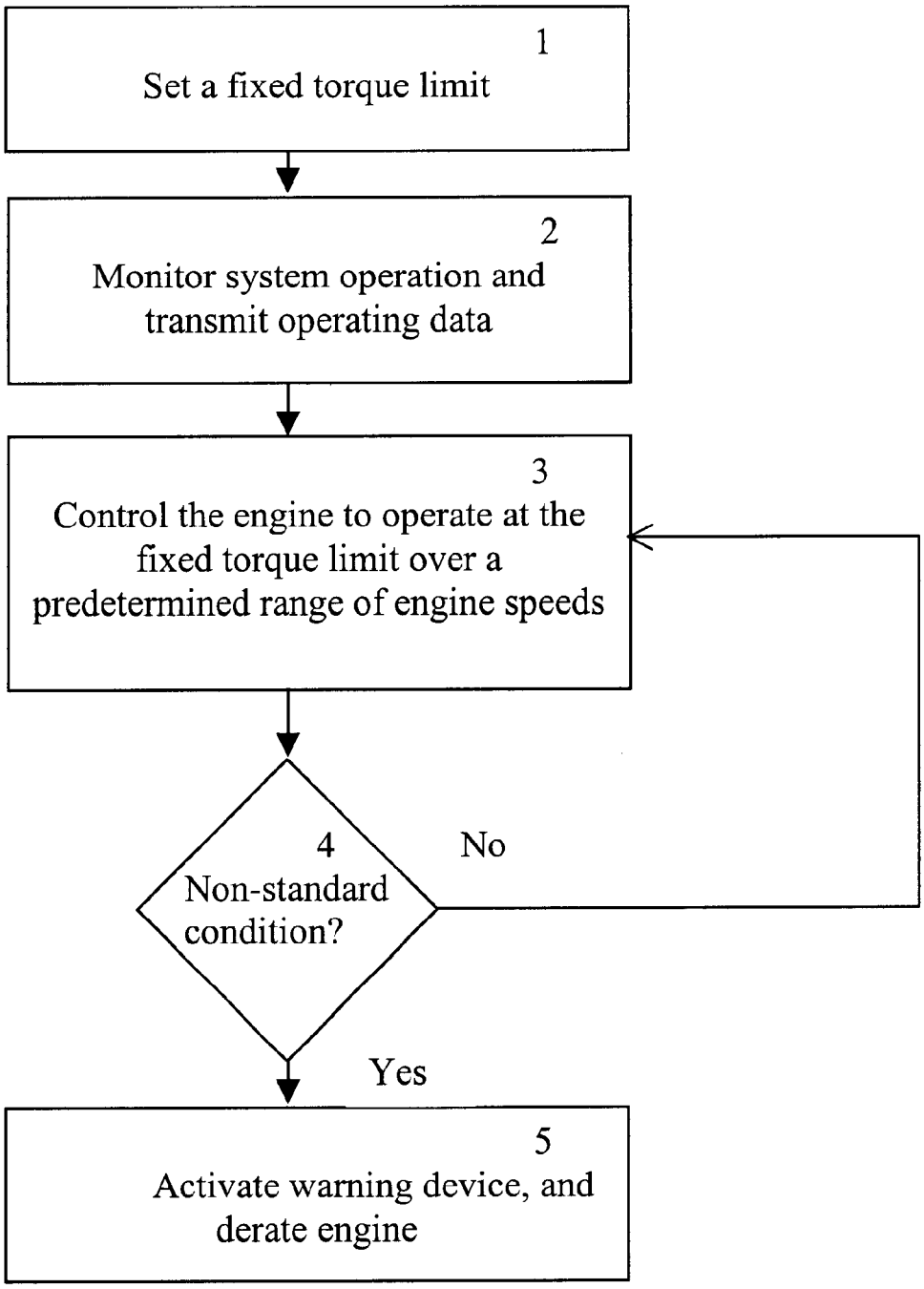
FIG. 5 is a block diagram depicting a method for controlling engine torque of an engine according to one embodiment the present invention.

FIG. 5 discloses a method for controlling engine torque of an engine according to one embodiment of the invention. Once for example, a dredging operation is begun, the operator, as shown in block 1, sets a fixed torque limit. As indicated in block 2, the system is monitored during the dredging operation and system operating data is continually transmitted to, for example, an electronic device of the present invention. Block 3 shows that the engine is controlled, using the transmitted system operating data, to operate at the fixed torque limit over a predetermined range of engine speeds. The method may include a decision feature as shown in block 4, wherein if a non-standard system condition is detected by the sensors, a warning device may be activated to warn the operator of a non-standard system operating condition, and the electronic device may derate the engine accordingly as indicated in block 5.

In another method of the present invention, instead of setting a fixed torque limit as described above, the operator may set upper and lower torque limits, and the electronic device controls the engine to operate at, and between the upper and lower torque limits. Accordingly, this method allows flexibility in performing, for example, dredging operations, based on this torque range.

Industrial Applicability

In practice, during dredging operations, an engine 20 may be configured to drive multiple devices (e.g., the torque limit is set to enable the engine to drive multiple devices). When activated, such as by the input device, an electronic device 60 controls the engine 20 to operate at a predetermined torque limit, or controls the engine 20 to operate at, and between upper and lower torque limits. If a system sensor 50 indicates an out-of normal operating condition, the electronic device 60 may derate or cut-off the engine 20. The electronic device 60 includes a computer readable medium 70, on which is stored a computer program 80 used for controlling the engine. The computer program 80 stores instructions 90 which include torque maps based on engine temperature. These maps 100 are used in determining an amount of fuel needed by the engine 20 in order to maintain the fixed torque limit over a predetermined range of engine speeds, or to maintain the engine at, and between the two torque limits.

What is claimed is:

1. An apparatus for controlling the torque output from an engine comprising:

at least one torque receiving device coupled with the engine to receive a first portion of the torque output from the engine when at least one of the at least one torque receiving device is operating and operable to receive a second portion of the torque, the second portion being less than the first portion, when at least one of the at least one torque receiving device is not operating;

at least one sensor coupled with the at least one torque receiving device, the at least one sensor operable to transmit a first signal indicative of whether at least one of the at least one torque receiving device is operating;

a pump coupled with the engine to receive a third portion of the torque output from the engine; and an electronic device coupled with the first sensor to receive the first signal, the electronic device operable to transmit a second signal operable to reduce the amount of torque output by the engine when the first signal indicates that at least one of the at least one torque receiving device is not operating.

2. The apparatus of claim 1 wherein the electronic device is operable to transmit the second signal when the first signal indicates that at least one of the at least one torque receiving device is not operating and when the third portion of torque is a quantity of torque that would cause damage to the pump.

3. The apparatus of claim 2 wherein the electronic device is not operable to transmit the second signal when the third portion of torque is not a quantity of torque that would cause damage to the pump.

4. The apparatus of claim 1 wherein the second signal is operable, when the at least one of the torque receiving device is not operating, to reduce the third portion of the torque received by the pump to be a quantity less than a quantity of torque that would cause damage to the pump.

5. The apparatus of claim 1 wherein the second signal is operable, when the at least one of the torque receiving device is not operating, to reduce the amount of torque output by the engine to a quantity less than a quantity of torque that would cause damage to the pump.

6. The apparatus of claim 1 wherein the second signal is operable to control the amount of fuel delivered to the engine.

7. The apparatus of claim 1 wherein the at least one torque receiving device comprises a propeller.

8. The apparatus of claim 1 wherein the sum of the second portion and the third portion is substantially equal to the total torque output from the engine.

9. The apparatus of claim 1 wherein the sum of the first portion and the third portion is substantially equal to the total torque output from the engine.

10. A method for controlling the torque output from an engine having a pump and at least one other torque receiving device operable to receive torque from the engine, comprising:

determining whether the at least one other torque receiving device is receiving torque from the engine; and reducing the amount of torque output from the engine when the at least one of the other torque receiving device is not receiving torque from the engine.

11. The method of claim 10 wherein reducing the amount of torque output from the engine comprises:

reducing the amount of torque output from the engine when the at least one of the other torque receiving device is not receiving torque from the engine and the quantity of torque received by the pump if the reduction in torque output by the engine did not occur would be a quantity of torque that would cause damage to the pump.

12. The method of claim 10 wherein at least one of the at least one other torque receiving devices comprises a propeller.

* * * * *

UNITED STATES PATENT AND TRADEMARK OFFICE

CERTIFICATE OF CORRECTION

PATENT NO. : 6,536,402 B2
DATED : March 25, 2003
INVENTOR(S) : Thomas J. Houchin et al.

It is certified that error appears in the above-identified patent and that said Letters Patent is hereby corrected as shown below:

Column 6,
Line 33, after "torque from the engine" insert -- and the amount of torque that the pump would otherwise receive if the reduction in the amount of torque output from the engine did not occur would be a quantity of torque that would cause damage to the pump --.

Signed and Sealed this

Fifth Day of August, 2003

JAMES E. ROGAN
*Director of the United States Patent and Trademark Office*